US011519226B2

(12) United States Patent
Schicker

(10) Patent No.: US 11,519,226 B2
(45) Date of Patent: Dec. 6, 2022

(54) PIVOT COUPLING

(71) Applicant: FLEXIDRILL LIMITED, Auckland (NZ)

(72) Inventor: Owen Schicker, Timaru (NZ)

(73) Assignee: FLEXIDRILL LIMITED, Auckland (NZ)

( * ) Notice: Subject to any disclaimer, the term of this patent is extended or adjusted under 35 U.S.C. 154(b) by 158 days.

(21) Appl. No.: 16/969,359

(22) PCT Filed: Feb. 15, 2019

(86) PCT No.: PCT/IB2019/051217

§ 371 (c)(1),
(2) Date: Aug. 12, 2020

(87) PCT Pub. No.: WO2019/159113

PCT Pub. Date: Aug. 22, 2019

(65) Prior Publication Data

US 2021/0047888 A1 Feb. 18, 2021

(30) Foreign Application Priority Data

Feb. 16, 2018 (NZ) ..... 739998

(51) Int. Cl.
*E21B 17/02* (2006.01)
*E21B 23/14* (2006.01)

(52) U.S. Cl.
CPC ..... *E21B 17/023* (2013.01); *E21B 23/14* (2013.01)

(58) Field of Classification Search
CPC ..... E21B 31/12; E21B 31/18; E21B 31/20; E21B 17/023; E21B 23/14
See application file for complete search history.

(56) References Cited

U.S. PATENT DOCUMENTS 3,360,059 A * 12/1967 Gaylord ..... E21B 31/12 175/259
7,217,056 B2 5/2007 Cooper
(Continued)

FOREIGN PATENT DOCUMENTS

WO 2017/079801 A1 5/2017

OTHER PUBLICATIONS

International Search Report issued in PCT/IB2019/051217; dated May 16, 2019.
Written Opinion issued in PCT/IB2019/051217; dated May 16, 2019.

*Primary Examiner* — Christopher J Sebesta
(74) *Attorney, Agent, or Firm* — Studebaker & Brackett PC

(57) ABSTRACT

The present invention relates to a wireline retrieval head assembly and downhole tool, the wireline retrieval head assembly for coupling to the downhole tool for installation in and retrieval from downhole in a mineral industry field of use, wherein a first of the wireline retrieval head assembly and downhole tool has a retention member that has or is configured to receive a pivot member and a second of the wireline retrieval head assembly and downhole tool has a complementary link with an opening for receiving the pivot member, such that the link can be coupled to the retention member to create a pivot coupling to allow for articulation between the wireline retrieval head assembly and the downhole tool during installation and retrieval of the downhole tool, and the link can be removed from the retention member to remove the downhole tool from the wireline retrieval head assembly.

14 Claims, 10 Drawing Sheets

(56) References Cited

U.S. PATENT DOCUMENTS

| | | | | |
|---|---|---|---|---|
| 8,333,255 | B2 | 12/2012 | Drenth | |
| 2007/0044448 | A1 | 3/2007 | Bosley et al. | |
| 2010/0012383 | A1* | 1/2010 | Drenth | E21B 25/02 175/246 |
| 2014/0311733 | A1* | 10/2014 | Alix | E21B 31/12 166/98 |
| 2018/0171735 | A1* | 6/2018 | Salvador | E21B 31/20 |

* cited by examiner

PIVOT COUPLING

FIELD OF THE INVENTION

The present invention relates to a coupling for or incorporated into a wireline retrieval assembly and/or downhole tool to assist with drilling and coring in the mineral industry.

BACKGROUND OF INVENTION

Wireline retrieval assemblies assist with the installation (deployment) of and retrieval of downhole apparatus for drilling and/or coring in the mineral industry (mineral exploration and mining). Reference to drilling and/or coring in the mineral industry, refers to, without limitation, to any exploration, mining, logging and/or survey of mineral deposits in the ground. Typically, these drilling and/or coring systems have the hammer or drive system at the top of the hole. These systems drive the tool while it is downhole.

A wireline retrieval assembly comprises a plurality of members interacting to install/deploy downhole and retrieve tools from downhole. Referring to FIG. 1, a wireline retrieval assembly can comprise but is not limited to, a head assembly, an overshot and a wireline. The wireline retrieval assembly is adapted to couple to a downhole tool. The head assembly has a spear head, and the overshot has a complementary engagement portion to attach and detach from the spear head of the head assembly. The overshot of the wire line retrieval assembly is connected to a wireline that can lower the wire line retrieval assembly and connected downhole tool downhole to install (deploy) the tool, and likewise hoist up and retract the wire line retrieval assembly and tool to retrieve the tool from the downhole.

A typical installation ("deployment" is an equivalent term that can be used interchangeably with "installation")/retrieval procedure is as follows. A borehole is drilled using a drill bit coupled to rotating drill rods. When drilling such holes in the ground a core sample can be taken. This is done by leaving the drill rods in place and using a wireline retrievable diamond coring system to take a core sample. A coring tool is lowered downhole into the drill rods and once the core sample is taken, the coring tool is retrieved to surface on a wire line (winch) controlled by a drill rig. To retrieve the coring tool, the wireline and overshot is lowered downhole and when it reaches the top of the head assembly it engages to connect with the head assembly. The head assembly is attached to the coring tool. As the coring tool, head assembly and overshot are removed from the ground they are lifted clear of the drill rods (that line the borehole) by the wireline, then a helper (off sider or operating personnel) supports/guides the unsupported bottom end of the inner tube of the coring tool as the wireline winch is slowly lowered, then the helper will guide the assembly onto trestles (table or other) whereby the inner core tube assembly containing the core sample is then disconnected from the wireline and overshot by unwinding a threaded connection, leaving the full core barrel on the trestles. The wireline and overshot are then reconnected, again using a threaded connection, to another empty inner core tube assembly. The assembly is again lifted off the trestles by the wireline—with an offsider guiding the assembly back into the drill rods, where it is lowered back downhole so drilling can recommence. Once the coring tool is in place, the overshot is disengaged and the head assembly and coring tool remain downhole. Whilst the empty inner core tube assembly is being lowered down hole, the offsider empties the full inner core tube that has been bought back to surface for analyses.

The core sample is emptied form the inner tube by first undoing a threaded connection at the inner tube head assembly, the sample is then emptied from the open tube and the head assembly when it returns from being downhole is then threadably reconnected to the empty inner core tube, ready for the next run. This process is repeated many times throughout a day.

Use of existing wireline retrieval assemblies present health and safety dangers to operators. The inner core tube assembly and overshot assembly are long, slender and heavy, so handling the overshot and inner core tube assembly as it is removed from the drill rig for analyses (and redeploying the assembly back down the hole) without damaging the equipment or causing injuries can be challenging.

Complicating this, the bore holes are often drilled at an angle and the offsider must handle and empty the inner tube assembly within a confined space of a drill stack or in an underground cavern, or with a small drill rig. Thus, the weight of the assembly that the offsider needs to support adds considerable risk of injury or damage while the assembly is moved to and from the trestles. Even on automated drill rigs, where the assembly is handled by a robotic arm, the offsider is still required to threadably remove the heavy head assembly from the core barrel, and re attach the head assembly to an empty core barrel—so that drilling can resume efficiently.

Additionally, this repeated connecting and disconnecting of heavy threaded components is time consuming, dangerous and the components can easily be damaged. For example, by cross threading.

SUMMARY OF INVENTION

It is an object of the present invention to provide a pivot coupling and/or wireline retrieval assembly with a pivot for wireline retrieval operations.

In one aspect the present invention may be said to comprise a wireline retrieval head assembly and downhole tool, the wireline retrieval head assembly for coupling to the downhole tool for installation in and retrieval from downhole in a mineral industry field of use, wherein a first of the wireline retrieval head assembly and downhole tool has a retention member that has or is configured to receive a pivot member and a second of the wireline retrieval head assembly and downhole tool has a complementary link with an opening for receiving the pivot member, such that the link can be coupled to the retention member to create a pivot coupling to allow for articulation between the wireline retrieval head assembly and the downhole tool during installation and retrieval of the downhole tool, and the link can be removed from the retention member to remove the downhole tool from the wireline retrieval head assembly.

Optionally the retention member has a coupling for removably attaching the retention member to the first of the wireline retrieval head assembly or downhole tool; and/or the complementary link has a coupling for removably attaching the retention member to the second of the wireline retrieval head assembly or downhole tool.

Optionally the retention member integrated with the first of the wireline retrieval head assembly or downhole tool; and/or the complementary link is integrated with the second of the wireline retrieval head assembly or downhole tool.

Optionally the retention member has lateral extensions to laterally retain and/or rotationally restrain the link when coupled.

Optionally the link is a hook with an opening and the retention member is a clevis with a pivot pin as the pivot member.

Optionally the wireline retrieval head assembly and tool further comprise a retention pin and an aperture through the hook such that the retention pin can be installed in the aperture to secure the hook to the clevis.

Optionally the link is a rod with an opening and the retention member is a clevis with a removable pivot pin as the pivot member.

Optionally the wireline retrieval head assembly and tool further comprise further comprising a further tool coupled to and forming part of the head assembly.

Optionally the downhole tool is anyone of:

coring tool
drilling tool
hammering tool
surveying tool
logging tool

Optionally the wireline retrieval head assembly is adapted to be detachably coupled to an overshot, the overshot for coupling to a wireline, wherein a first of the overshot and wireline has a retention member that has or is configured to receive a pivot member and a second of the overshot and wireline has a complementary link with an opening for receiving the pivot member, such that the link can be coupled to the retention member to create a pivot coupling to allow for articulation between the overshot and wireline to enable installation and retrieval of the downhole tool, and the link can be removed from the retention member to remove the wireline retrieval from the overshot.

Optionally a first of the wireline and downhole tool has a retention member that has or is configured to receive a pivot member and a second of the wireline and downhole tool has a complementary link with an opening for receiving the pivot member, such that the link can be coupled to the retention member to create a pivot coupling to allow for articulation between the wireline and downhole tool to enable installation and retrieval of the downhole tool, and the link can be removed from the retention member to remove the wireline from downhole tool.

In another aspect the present invention may be said to comprise a pivot coupling to removably and pivotably couple a wireline retrieval head assembly and a downhole tool for installation in and retrieval from a downhole in a mineral industry field of use, wherein the pivot coupling comprises a retention member that has or is configured to receive a pivot member, the retention member integrated in or configured to connect to a first of the wireline retrieval assembly and downhole tool; and a complementary link with an opening for receiving the pivot member, the link integrated in or configured to connect to a second of the wireline retrieval head assembly and downhole tool, such that in use the link can be coupled to the retention member and pivot member to create the pivot coupling between the wireline retrieval head assembly and the downhole tool during installation and retrieval of the downhole tool, and the link can be removed from the retention member and pivot member to remove the downhole tool from the wireline retrieval assembly.

Optionally the retention member has lateral extensions to laterally retain and/or rotationally restrain the link when coupled.

Optionally the link is a hook with and opening and the retention member is a clevis with a pivot pin as the pivot member.

Optionally the pivot coupling further comprises a retention pin and an aperture through the hook such that the retention pin can be installed in the aperture to secure the hook to the clevis.

Optionally the link is a rod with an opening and the retention member is a clevis with a removable pivot pin as the pivot member.

Optionally the downhole tool is any one of:

coring tool
drilling tool
hammering tool
surveying tool
logging tool

In another aspect the present invention may be said to comprise a method of installing a tool downhole in a mineral industry field of use using a wireline retrieval assembly comprising an overshot coupled to a wireline retrieval head assembly, the method comprising the steps of: coupling at least the wireline retrieval assembly to a downhole tool with a pivot coupling of any embodiment above, hoisting the wireline retrieval assembly from a surface or support using a wireline, in doing so at least the wireline retrieval assembly and downhole tool pivot at the pivot coupling, and lowering the wireline retrieval assembly and tool downhole.

Optionally the method further comprises detaching the overshot from the wireline retrieval head assembly.

In another aspect the present invention may be said to comprise a method of retrieving a tool from downhole as installed according to the method above comprising the steps of: retrieving the wireline head assembly and downhole tool using a wireline and overshot to hoist the downhole from downhole, lowering the wireline retrieval assembly and tool to lay the assembly on a support or surface, in doing so the wireline retrieval assembly and/or tool pivot at the pivot coupling, removing the link from the retention member to disassemble the wireline retrieval assembly from the tool to retrieve the tool.

In another aspect the present invention may be said to comprise a method of installing a tool downhole in a mineral industry field of use using a wireline and wireline retrieval assembly comprising an overshot coupled to a wireline retrieval head assembly, the method comprising the steps of: coupling a wireline to a tool with a pivot coupling of any statement above, lowering and retaining the tool downhole, coupling the wireline to a wireline retrieval assembly, hoisting the wireline retrieval assembly and coupling it to the tool with a pivot coupling of any statement above, lowering the wireline retrieval assembly and tool downhole to deploy the tool.

Optionally the method further comprises detaching the overshot from the wireline retrieval head assembly.

In another aspect the present invention may be said to comprise a method of retrieving a tool from downhole installed according to the method above comprising the steps of: retrieving the wireline head assembly using a wireline and overshot to hoist the wireline head assembly from downhole, decoupling the tool from the wireline head assembly and retaining the tool in the downhole, coupling the wireline to the tool and retrieving the tool from downhole using the wireline.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

Embodiments will be described with reference to the following figures, of which.

DETAILED DESCRIPTION OF EMBODIMENTS

Overview

In addition to the existing problems posed by wireline retrieval assemblies, the present applicants use wireline retrieval assemblies in a manner that extends the length of the head assembly. For example, the present applicants incorporate a hammering tool or other tool into the head assembly, which extends the length of the head assembly. Such extra long wireline retrieval assemblies cannot be maneuvered or used in confined spaces or small drill rigs where the rig is smaller than the wireline retrieval assembly, further exacerbating the problems described in the background.

Figure 1:
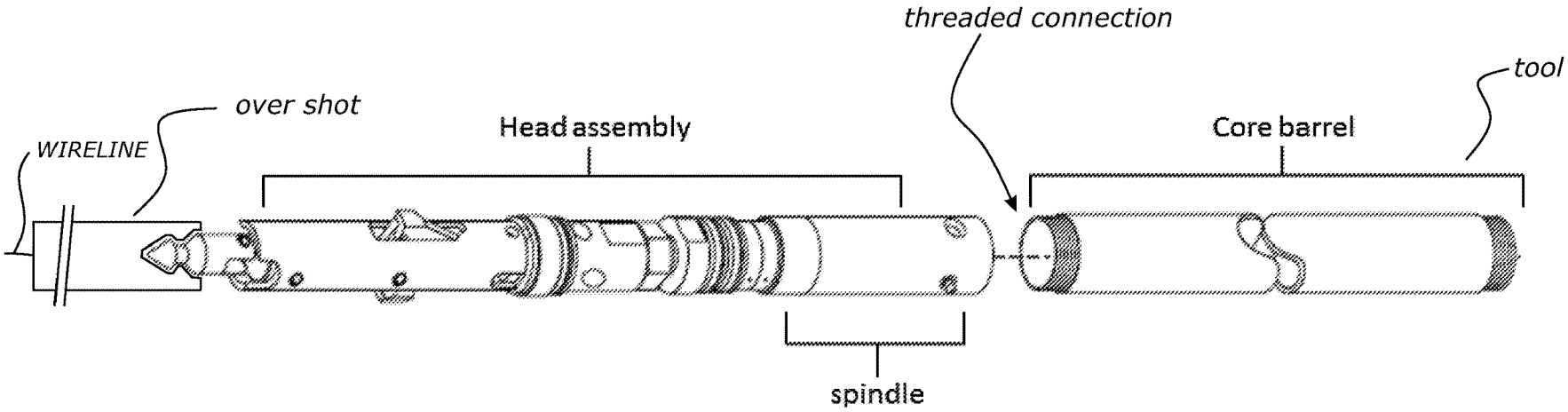
FIGURE 1 (Prior Art)
FIG. 1 prior art wireline retrieval assembly.
Figure 2A:
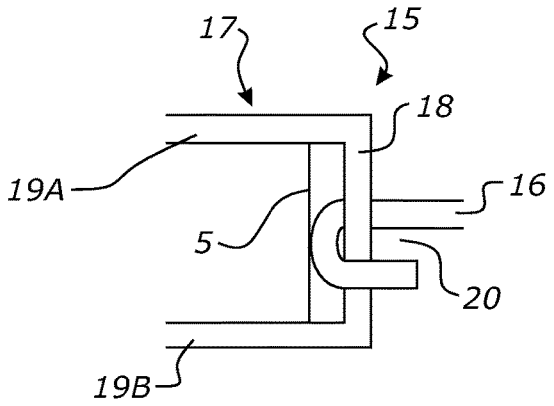
FIG. 2, 2A, 2B shows in diagrammatic form an overview of a wireline retrieval assembly with pivot couplings.
Figure 2:
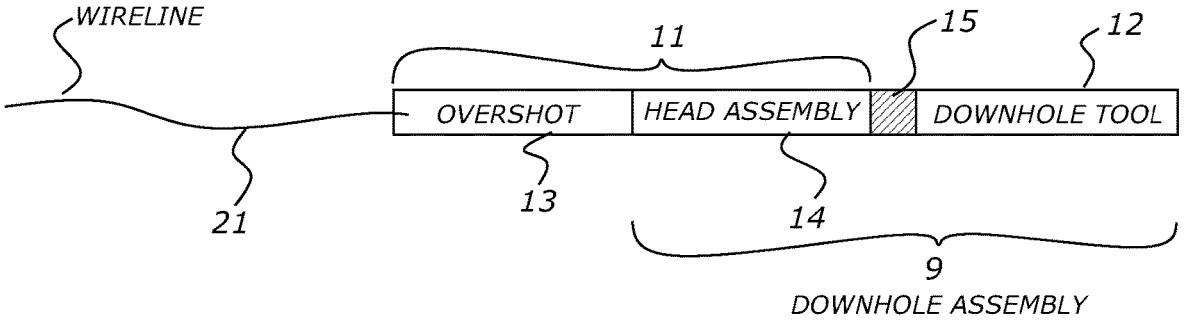

FIG. 2 shows in diagrammatic form a wireline retrievable assembly 11, comprising an overshot 13 with attached wireline 21, a head assembly 14, and a downhole tool 12 (such as a coring tool, logging tool, surveying tool, drilling tool, hammering tool) according to embodiments described herein. The overshot 13 and head assembly 14 are shown connected, but are detachable/engageable as described previously. The head assembly 14 might have a further tool incorporated (in addition to the downhole tool mentioned above), such as a hammering tool. The overshot once downhole can now be disengaged to deploy the head assembly and connected downhole tool 12.

The downhole tool ("tool") 12 is coupled with a pivot coupling 15 to the head assembly 14 of the wireline retrieval assembly 11. The pivot coupling 15 is described in the embodiments below. The head assembly 14 (with or without an incorporated tool) and the downhole tool 12 when coupled are termed a "downhole assembly" 9.

Referring to diagrammatic inset FIG. 2A, the pivot coupling 15 has two complementary coupling members; a link coupling member (also called "link" or "latch") 16 which removably engages to a retention coupling member (also called "retention member" or "keeper") 17. The retention member can take various configurations, but comprises a pivot member 18 on which the link 16 can removably engage, and lateral portions/extensions 19A, 19B that extend to the pivot member 18 and provide for lateral retention of the link—that is, when coupled the lateral portions prevent the link 16 sliding off the pivot member 18. The lateral extensions also allow rotational movement in the head assembly to be transferred to the tool 12, as the hook will abut against and be restrained by a respective lateral extension that is rotated. As an example, but not limiting, the retention member 17 can comprise a forked or U-shaped member providing lateral retention with a pivot pin or other pivot member extending between the forks or ends of the U-shape. The diagrammatic indication of the retention member in concept form in FIG. 2A can take various forms, such as a clevis as will be described later, but should not be limited by particular embodiments. Other examples not described, might include a metal hoop or loop or anything else that provides a pivot member and lateral extension that retains the link on the pivot member from sliding off. The retention member can be integrated with or removably couplable to one of the members of the assembly and/or downhole assembly that are being connected together. The retention member can have a coupling for being removably coupled for that purpose. The link 16 can take various configurations as will be described, but in general form has an opening 20 to engage with the pivot member 18 of the retention member 17, and also to be received within the lateral retention members 19A, 19B of the retention member. Preferably a camming surface or member 5 helps keep the link vertically retained. Preferably, a retention pin (described with respect to relevant embodiment(s) below) can also be provided in some embodiments to prevent the link from being uncoupled from the retention member unintentionally. The link can be integrated with or removably couplable to one of the members of the assembly and/or downhole assembly that are being connected together. The link can have a coupling for being removably coupled for that purpose.

Having a pivot coupling 15 between the head assembly 14 and the downhole tool 12 provides for safer installation and extraction of the downhole tool. As the wireline retrieval assembly and/or downhole tool can articulate/pivot at the pivot coupling(s) 15, and because the pivot coupling(s) 15 can be decoupled, this provides for a much more maneuverable assembly.

Figure 2B:
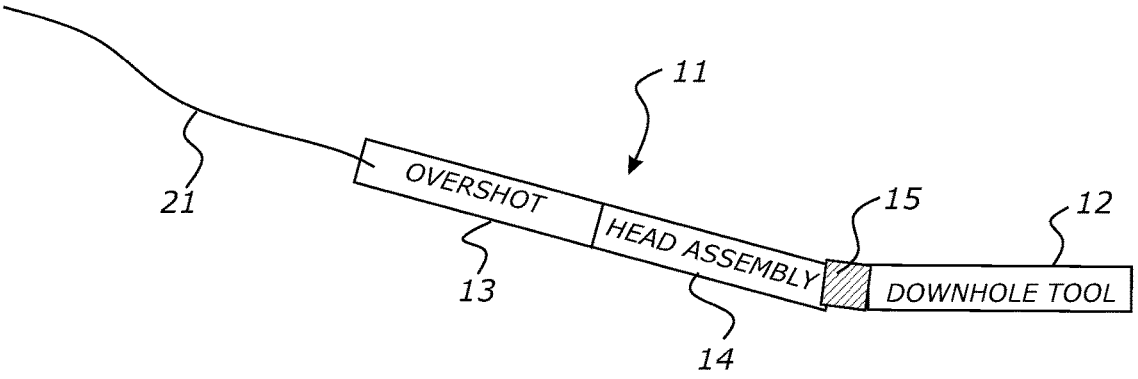

For example, installation of a downhole assembly (tool and head assembly) with a pivot coupling 15 can occur as follows. The wireline retrieval assembly 11 is laid flat on the ground or support and connected to a wireline 21—see FIG. 2. The downhole tool 12 is then connected to the wireline retrieval assembly 11 (in this case the head assembly part 14) via a pivot coupling 15 as described herein (which might comprise inserting a retention pin as described herein). The wireline 21 can then be hoisted to hoist the wireline retrieval assembly 11. As the wireline is hoisted, the wireline retrieval assembly can articulate at the pivot coupling 15 between the head assembly 14 and the downhole tool 12, allowing for controlled hoisting—see FIG. 2B. The articulation assists generally with controlled handling during the installation process to among other things minimise swinging and other dangers. Finally, with further hoisting of the wireline the entire wireline retrieval assembly and downhole tool can be lifted into a vertical configuration but in a controlled manner with minimal swinging. This enables deployment within a smaller/confined space (e.g. underground or small coring drill rigs with a short mast) with less concern of the wire line retrieval assembly swinging around uncontrollably. The operators can then guide the wire line retrieval assembly and downhole tool into the downhole position. The overshot 13 can be disengaged from the head assembly and retracted above ground using the wireline 21, leaving the head assembly 14 and tool 12 deployed downhole.

Similarly, with retrieval, a wireline 21 can be attached to the overshot 13 and the overshot lowered to re-attach to the head assembly downhole. The wireline retrieval assembly 11 and attached tool 12 are lifted out of the drill rods from downhole. The operator can then insert the retention pin, then carefully move the vertical wireline retrieval assembly and downhole tool to the support or the ground and then slowly lower the wireline 21. The entire assembly will articulate at the pivot coupling 15 between the wire line retrieval head assembly 14 and the tool 12 (see FIG. 2B). This allows for a much more controlled laying down of the overall assembly to minimise swinging and other dangers. The downhole tool can then be decoupled at the pivot coupling and another downhole tool attached for installation. This also allows for the various components (overshot, head assembly and tool) to be decoupled and handled separately, which assists operations.

The above is just one general example where there is a coupling 15 between the wireline and retrieval assembly. In an alternative, a second pivot coupling 15 can be placed between the wireline 21 and overshot 13 to provide additional articulation. This arrangement can be used when the drill rig is short. In other alternatives, a coupling (or multiple couplings) can be placed elsewhere in the arrangement. Two methods of deployment and retrieval are provided in more detail below by way of example, other embodiments of the apparatus have been described in more detail.

Pivot Coupling with a Clevis and Hook

One possible embodiment of a pivot coupling and its incorporation into a wireline retrieval assembly will be described with reference to FIGS. 2, 3 and 4. In this embodiment, the retention member takes the form of a clevis 40 with an optional removable pivot pin (pivot member) 41, and the link member takes the form of a hook 42.

Figure 3:
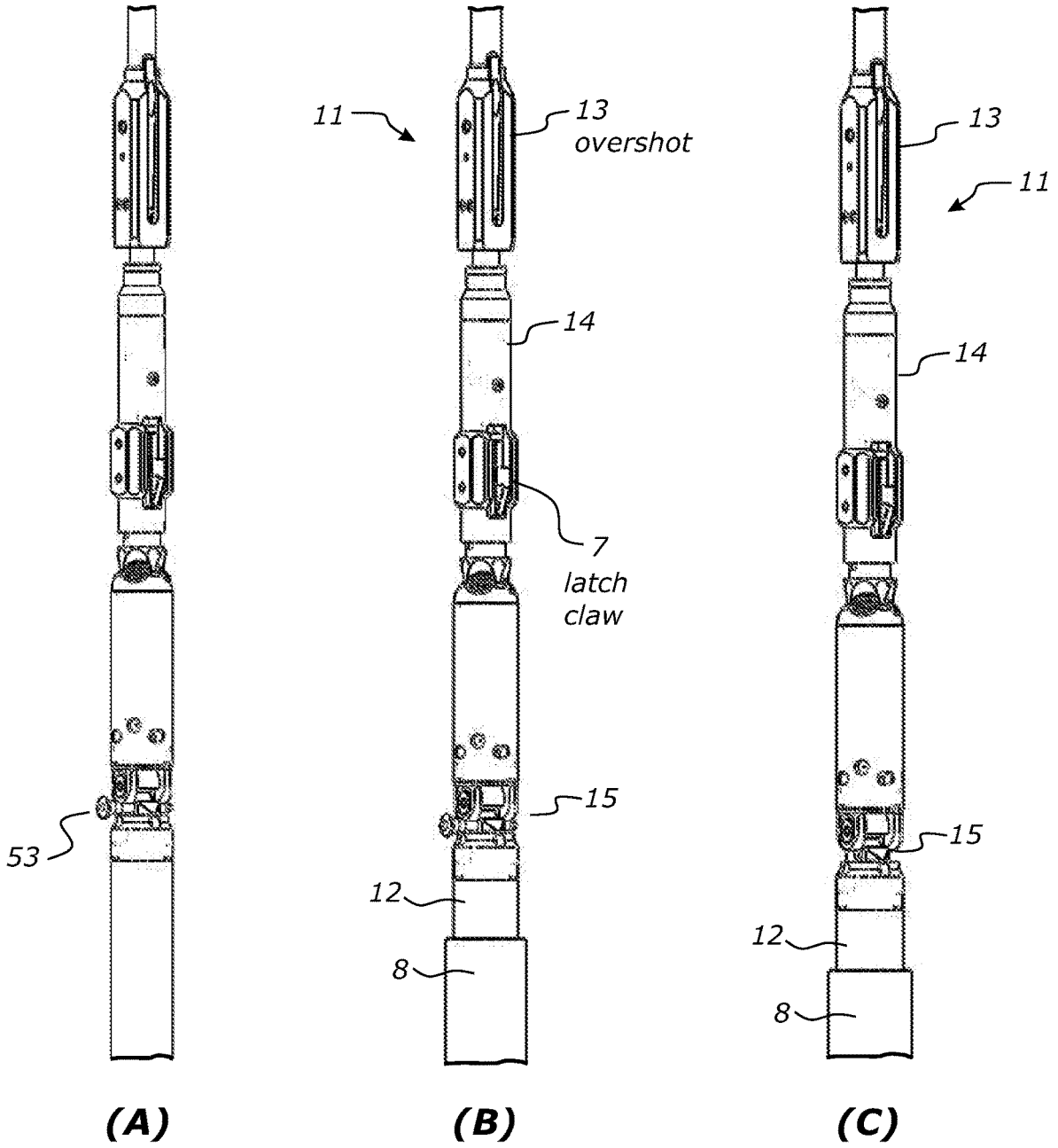
FIG. 3 shows various views of a wire line retrieval assembly with a hook pivot coupling in accordance with a first embodiment

FIG. 3 shows various stages of use of the wireline retrievable assembly 11. This includes drawing (A) where the pivot coupling is installed, drawing (B) where the assembly is initially lowered into a drill rods and drawing (C) where the pivot pin (to be described later) is removed so that the assembly can be fully lowered into the drill rods. The reverse order also applies for extraction of the assembly, whereby in drawing (C) the assembly is lifted out of the drill rods, and drawing (B) the pin is inserted into the pivot coupling, and drawing (A) where the assembly is fully extracted from the drill casing, and then handled to extract the core sample, and a) remove the coupling (if required), replace, remove or add components to the assembly, and/or re-install the assembly in the drill rods. Referring to FIG. 3, the wire line retrievable assembly 11 comprises an overshot 13 coupled to a head assembly 14. The head assembly has a latch 7 for coupling to drill rods to retain it in place. In this version of the embodiment, for simplicity, there is no pivot coupling at the top of the overshot. However, such a pivot coupling could be incorporated if required. A downhole tool 12 is coupled to the head assembly 14 of the wireline retrieval assembly 11 via a pivot coupling 15. This embodiment is described with reference to a coring tool, but the tool 12 could be any of a core catching barrel, a coring tool, hammering tool, drilling tool, surveying tool, logging tool or any other type of tool used in the mineral industry. Optionally, in addition the head assembly might have a coring tool, hammering tool, drilling tool, surveying tool, logging tool or any other type of tool used in the mineral industry incorporated into it (in addition to the tool attached to the head assembly). Where the head assembly has such a tool incorporated into it, reference to the head assembly is considered to cover the tool also. The head assembly has a latch 7 to retain the head assembly (with or without additional tool) 14 and downhole tool 12 in place downhole. FIG. 3 (drawings (B), (C)) shows the tool 12 partially inserted downhole in drill rods 8 that line the borehole previously drilled.

Figure 4:
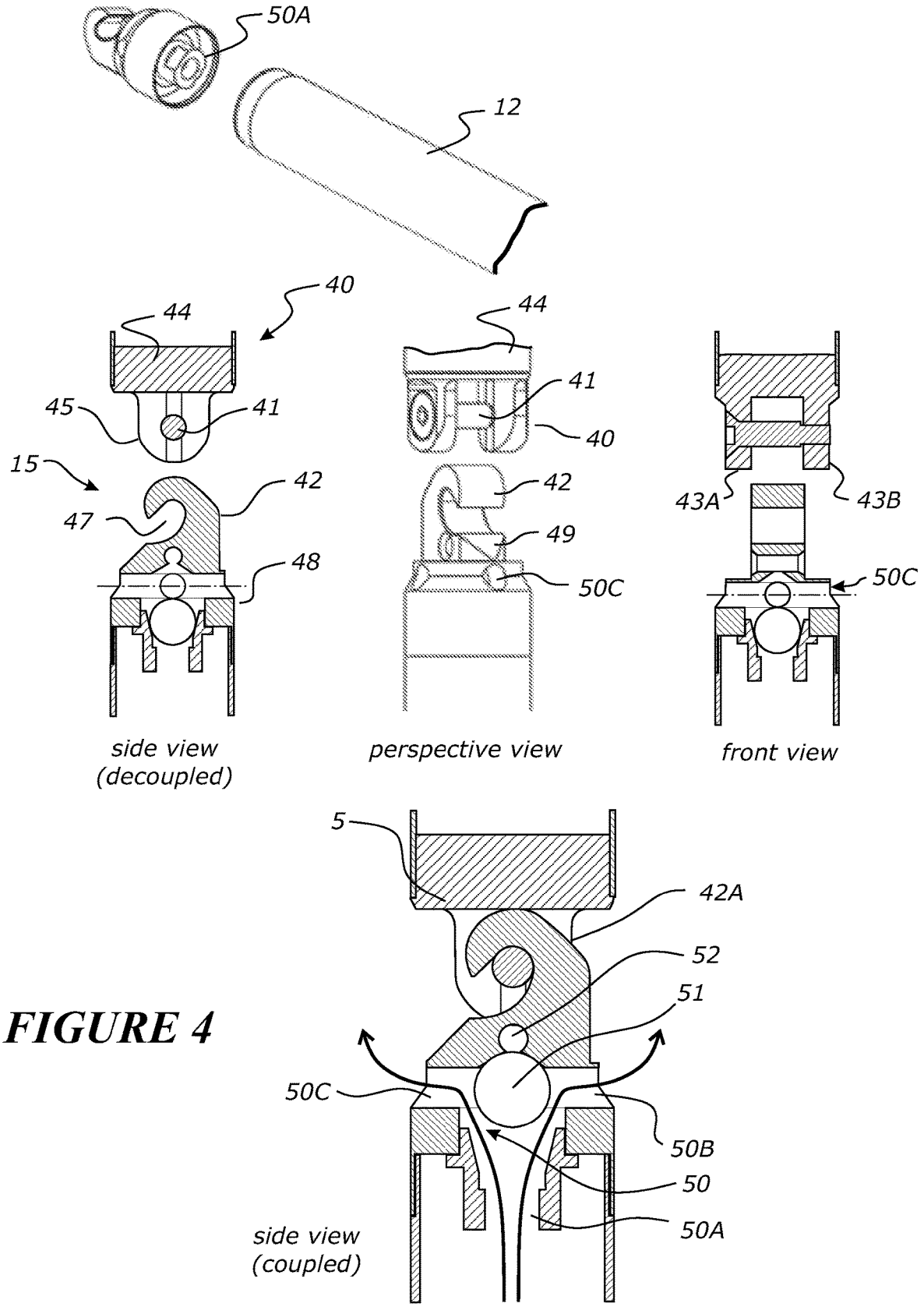
FIG. 4 shows the hook pivot coupling in further detail.

FIG. 4 shows the pivot coupling 15 in more detail. The clevis 40 comprises two lateral extensions 43A, 43B with apertures therethrough (not shown as they are filled with a pivot pin). The pivot pin 41 extends through the openings of each lateral extension 43A, 43B and across the gap between the lateral extensions. The pivot pin 41 could be fixed in place or removable. In this case, the pivot pin takes the form of a bolt that can be threaded into one of the lateral extension openings. The lateral extensions 43A, 43B extend from a base 44 that can be coupled to a wire line retrieval assembly member (head assembly 14 in this embodiment). For example, the base could be threaded and screwed onto a complementary thread on the wire line retrieval assembly member (head assembly) 14. (In a variation, the clevis 40 can be integrated with the wire line retrieval assembly member, such that the lateral extensions are integrated to an extent from the wire line retrieval assembly member (head assembly 14).) The lateral extensions are spaced apart at least as wide as the width of the hook 42 and are chamfered/radiused 46 to assist insertion of the hook between the two lateral extension members 43A, 43B as this provides radiused lead in edges and/or sides (edges). These radiused lead in edges 46, mean that when the operator is trying to engage or guide the hook into place, then if the hook is slightly off line the radiused lead in edges allow the hook to self-align into place. If there were no radiused lead in edges—then it would require the operator to align the hook exactly into place to allow the hook and clevis to engage. This would be fiddly and time consuming. The end of each lateral extension is rounded 45 to provide a camming surface for a retention pin to be described later. The lateral extensions 43A, 43B retain the hook in place when coupled and also restrain the hook to allow rotational movement in the head assembly to be transferred to the tool 12, as the hook will abut against a respective lateral extension that is being rotated. Also, the base 44 of the clevis has a camming surface 5 to retain the hook vertically in place when installed. This reduces vertical movement of the hook relative to the clevis.

The hook 42 is configured with a width that allows the hook to be inserted between the lateral extensions 43A, 43B of the clevis 40, and it has an opening 47 to engage around the pivot pin 41. A tapered, chamfered or shaped portion is formed into a butt 49 of the hook 42 to assist with insertion of the hook 42 into the clevis 40. The hook extends from a base 48 that can be coupled to a wire line retrieval assembly or downhole tool 12. For example, the base 48 could have a coupling could be threaded and screwed onto a complementary thread on the downhole tool. (In a variation, the hook can be integrated with the wire line retrieval assembly or downhole tool, such that the hook is integrated with and extends from the wire line retrieval assembly or tool.) In coring operations, the base 48 is cylindrical with an interior region comprising a channel 50 (comprising 50A, 50B, 50C) for flow of drilling or coring fluid during operation, particularly when the assembly is going back down hole. The channel 50 is formed as a cylindrical pipe 50A extending in the base 48 and flow channel apertures 50B, 50C extending horizontally through the base 48 to the exterior. The top portion of the base channel is a rounded seat to receive a bearing 51 that forms a check valve. This valve allows the fluid or mud to flow back uphole and through the inner tube of a coring tool barrel as the assembly is going back down hole. This prevents drilling fluid or mud clogging up the barrel and slowing the process going back downhole.

The static fluid downhole is expelled through the channel 50A, past the check valve 51 and out through the flow channel apertures 50B, 50C when the downhole tool 12 is inserted downhole. In the absence of such fluid, the bearing 51 will under gravity fall to block flow of fluid through the channel 50A. The check valve may be considered to comprise the seat, a round ball and then directly above the inlet/outlet fluid ports. The front view shows the ball seated in the valve where no fluid is flowing. In use as the assembly is moving downhole, fluid is moving back uphole. This fluid pushes the ball away from its currently seated position and then flows out through the inlet/outlet ports.

Figure 5:
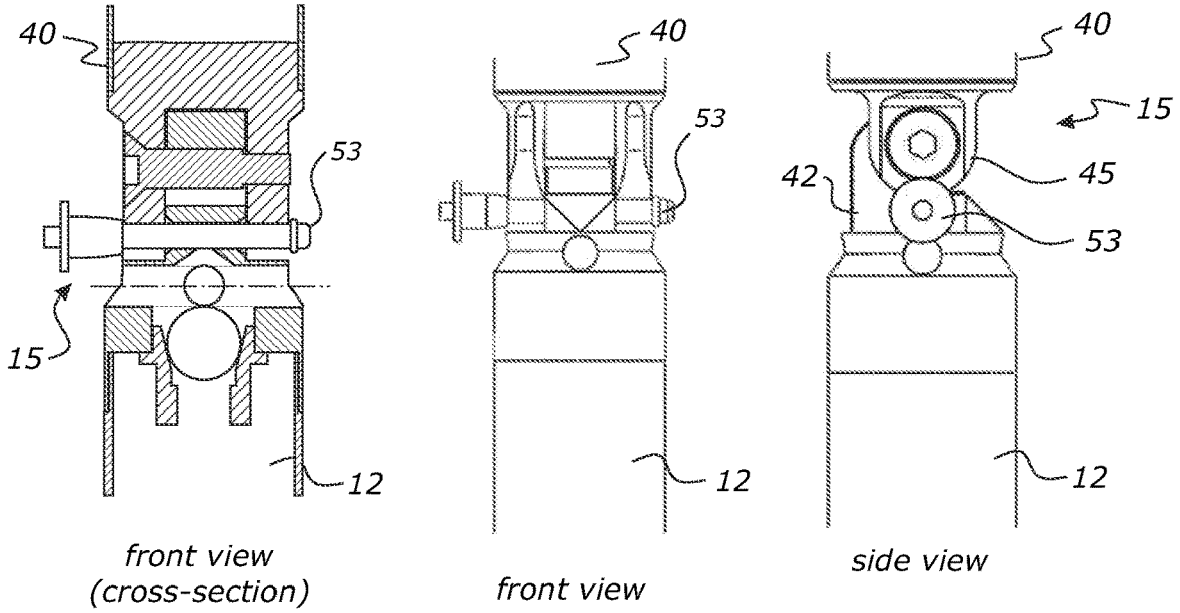
FIG. 5 shows the hook pivot coupling with a retention pin to retain the hook in place.
Figure 5:
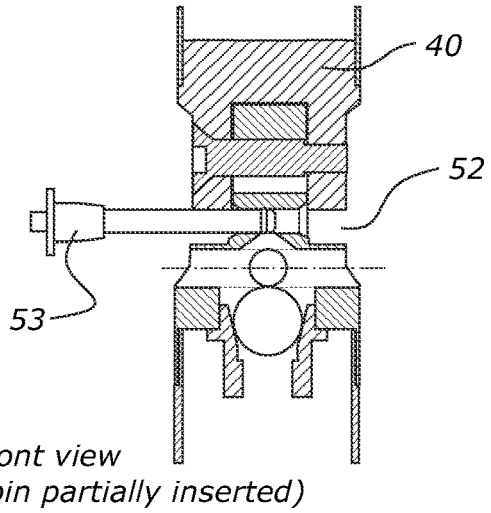
Figure 6:
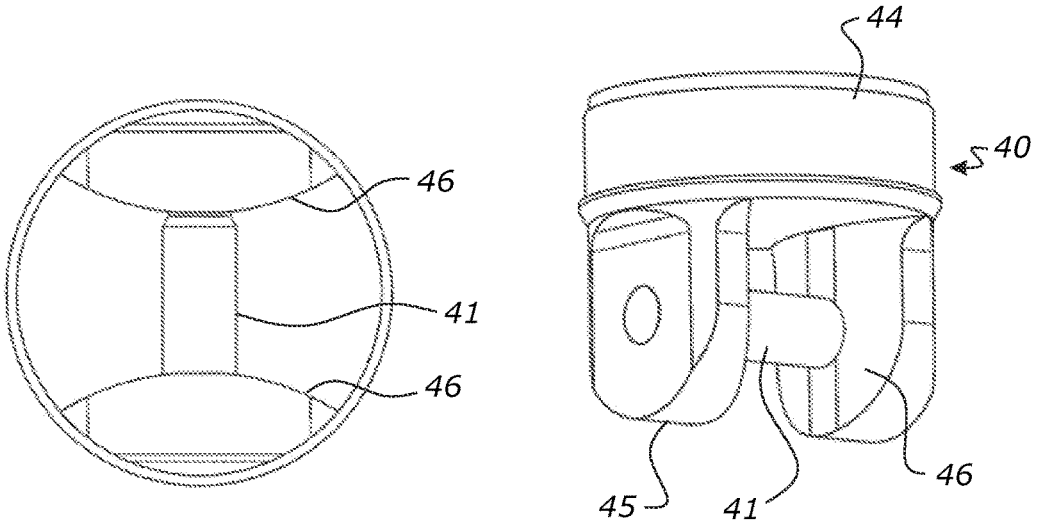
FIG. 6 shows a clevis of the hook pivot coupling in further detail.

Referring to FIG. 5, when hook 42 has been coupled to the clevis 40. The hook coupling comprises an aperture 52 therethrough for a retention pin 53, which may be spring-loaded and/or may have a retention dent, spring bearing, spring-loaded safety pin or other member to retain it in place. The hook 42 is dimensioned and the retention pin opening 52 is positioned such that when the hook 42 is coupled to the clevis 40 and the retention pin 53 is inserted, the retention pin abuts against the curved camming surface 45 of the lateral extensions 43A, 43B (see FIG. 6). This keeps the hook securely in place so that the hook cannot be inadvertently decoupled from the clevis, while still allowing the hook to articulate around the lateral extensions as the retention pin follows camming surface 45. That is, the J shape in the hook doesn't allow the hook to be removed from the clevis until the retention pin is removed. The hook 42 also abuts the base camming surface 5, which keeps the hook retained to reduce vertical movement.

The hook 42 can be coupled to the clevis 40 by engaging the hook opening over the pivot pin 41. The hook in the clevis once engaged form the pivot coupling 15. The spring-loaded retention pin is positioned in the opening 52—so that then in position the hook and clevis cannot be separated. The camming surface 45 on the clevis allows the angular movement (articulation) of the retention pin, while reducing the possibility of the hook and clevis from accidentally separating. Additionally, the inside walls of the clevis are radiused 46 (or alternatively chamfered, tapered or otherwise shaped) to provide a guide path for the hook. The retention pin 15 is inserted between the hook and clevis, once the assembly is out of the drill rods or is immediately uphole. The pin 15 can be spring-loaded and/or may have a retention dent, spring bearing, spring loaded safety pin or other member to retain it in place. The pin 15 is removed again before the assembly is lowered back down hole (the hook and clevis can only be separated by moving one at an angle greater than e.g. 45° to the other.) FIG. 5 shows a ball locking pin as a possible option but any type of retention pin such as a lynch pin, wire clasp pin, R clip or the like could be used.

The hook assembly in this embodiment is positioned between the head assembly and tool (inner core tube of a coring tool in this embodiment). The hook can be removed by first removing the retention pin 53, and then rotating the hook around to a flattened portion 42A of the hook that allows it to be pushed towards the base of the clevis and then removed away from the pivot pin and disengaged.

In this embodiment, the clevis and the hook member are shown attached to the head assembly 13 and downhole tool 12 respectively. It will be appreciated that this is not essential and the clevis 40 and hook 42 could be swapped around and attached in an opposite configuration to the head assembly and downhole tool. In other variations, the clevis and hook (together pivot coupling 15) could alternatively or additionally be situated between the overshot and wireline in any configuration, or between any other members of the wireline retrieval assembly, and/or between multiple linked downhole tools. In another embodiment to be described later, a pivot coupling 15 as described herein is placed between the wireline 21 and overshot 13 and another between the head assembly 14 and tool 12.

Figure 7:
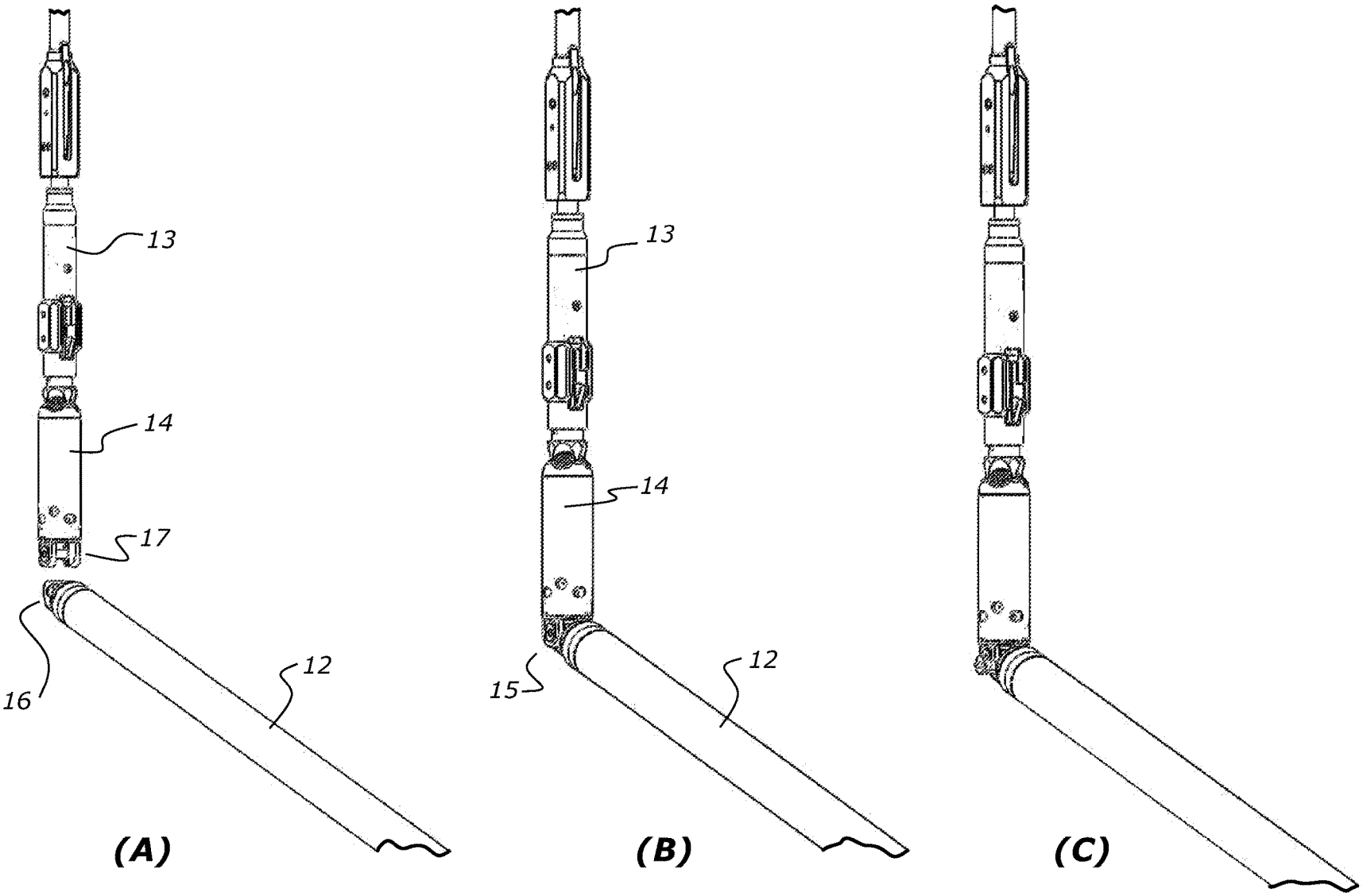
FIG. 7 shows the articulating assembly.

Referring to FIG. 7, once coupled the wireline assembly 11 can articulate relative to the downhole tool 12 about the pivot coupling 15. This allows for much easier installation and retrieval as previously described in the overview, and as will be described in further detail below.

The pivot coupling can be used with any downhole tools that are wireline deployed or retrieved—with or without a check valve. Using the hook as shown in a coring application is one of a number of applications that this pivot coupling could be used for and this would have a check valve. If this pivot coupling is used to attach/release survey tools—then a check valve may not be needed.

A method of deploying and retrieving a tool using a wireline retrieval assembly with a pivot coupling will be described later.

In general terms, the pivot coupling optionally does one or more of the following when used in a wireline retrieval assembly as described.

- Provide some degree of angular movement (articulation) between the head assembly and the downhole tool, or between other members where the pivot coupling is used. For example, with an inner core tube of a coring tool, it allows the inner core tube to be handled within a smaller space effectively allowing the assembly to be angularly moved as two pieces (articulate)—while being connected as one. It also eases the coupling and decoupling process of components to the assembly. This eases handling and makes it safer.
- Allows rotation of the head assembly to be transferred to the tool.
- Eliminates or reduces the use of heavy threads that connects the components—these are easily damaged, and can cause cuts and strain injuries to the offsider. The preferably small light weight hook component of the invention can be threadably disconnected and reattached to an inner core tube when removing a core sample.
- An offsider no longer has to handle such a heavy and cumbersome downhole tool as the present invention allows the tool assembly to be decoupled from the head assembly during deployment and retrieval procedures. Further the present invention allows the wireline retrieval assembly to be made into smaller portions as the pivot couplings can be interspersed in between.
- Has a built-in safety mechanism that prevents the pivot coupling unintentionally coming apart and posing a safety threat to the offside.
- Requires no additional tools to separate or put back together (make/break).

Is small, lightweight, fast, and simple to use, that can be used in dirty environments where dirt, mud, rock cuttings, dust etc are present. Additionally, it is robust which is important for the environment in which it is being used in.

Puts a connector between the head assembly and the tool that is able to be connected—disconnected, without the use of tools or threads.

A connector placed between the inner tube head assembly and the tool that is able to be connected and disconnected that allows for +/−80 or more degrees of angular rotation.

Puts a connector placed between the head assembly and the tool, that is able to be easily connected—disconnected.

Puts a connector placed between the head assembly and the tool, that is able to be connected—disconnected whereby a spring loaded pin or similar pin prevents the clevis and hook from separating providing additional safety features to the offsider. Further the spring loaded spring or similar pin bears against the curved edge of the clevis—so the clevis acts as a cam to allow angular movement of the tool relative to the head assembly.

Puts a connector placed between the head assembly and the downhole tool, where the head assembly contains an optional check valve.

Provides a quick release coupling that preferably allows up to about or equal to 90 degrees of angular movement without any risk of slipping, or prematurely uncoupling and or causing damage or injury.

Enables the use of a wireline retrieval assembly in space confined areas, such as underground and/or wireline retrieval assemblies that may be longer than the drill rig itself The taper on the butt of the hook makes it easier to insert the hook into the clevis. This reduces risk and improves ease-of-use when guiding the hook into place.

Alternative Embodiments

Figure 8:
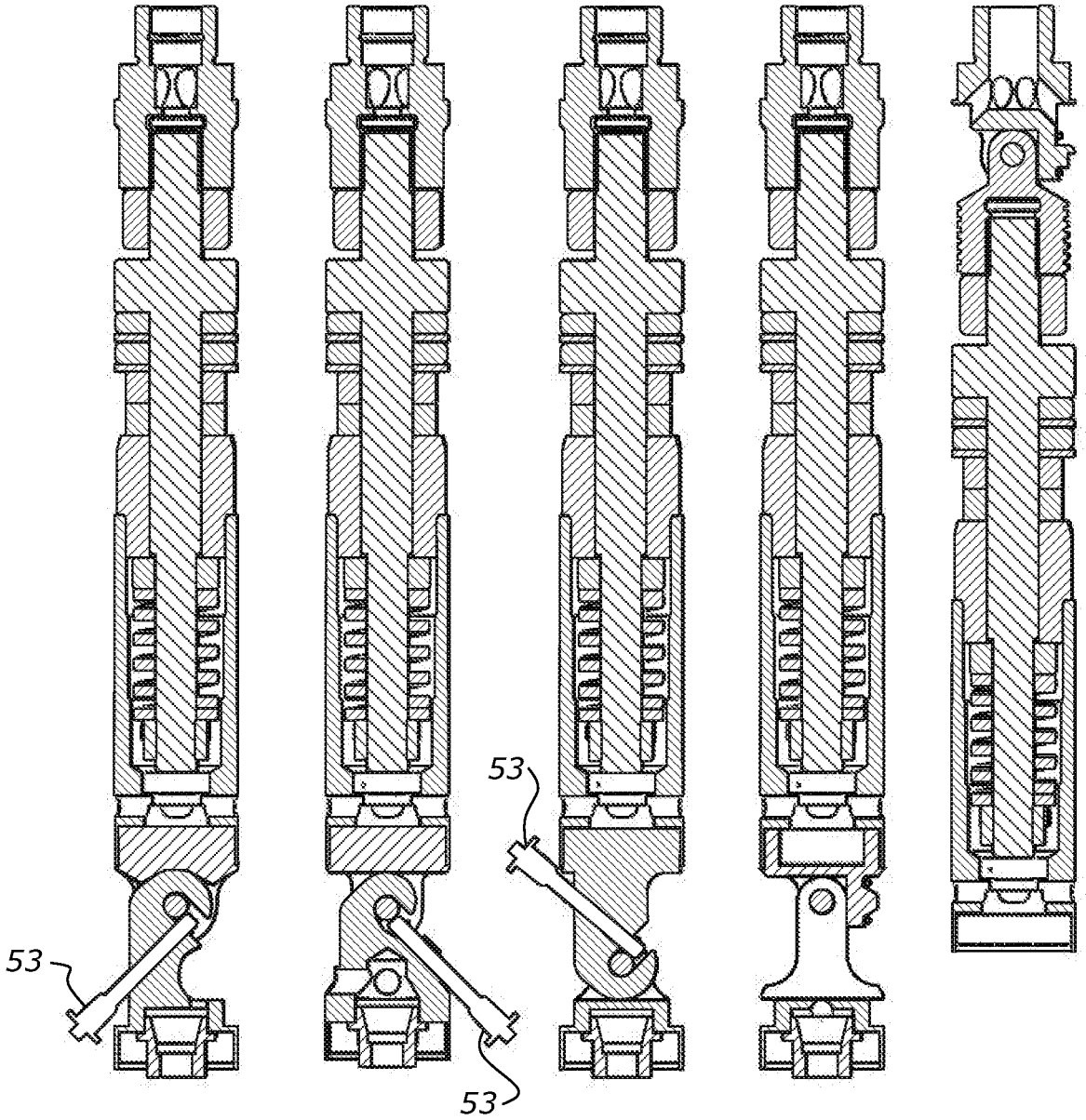
FIG. 8 shows alternative variations of the first embodiment.

FIG. 8 show alternative embodiments, with different positions for the retention pin.

Figure 9:
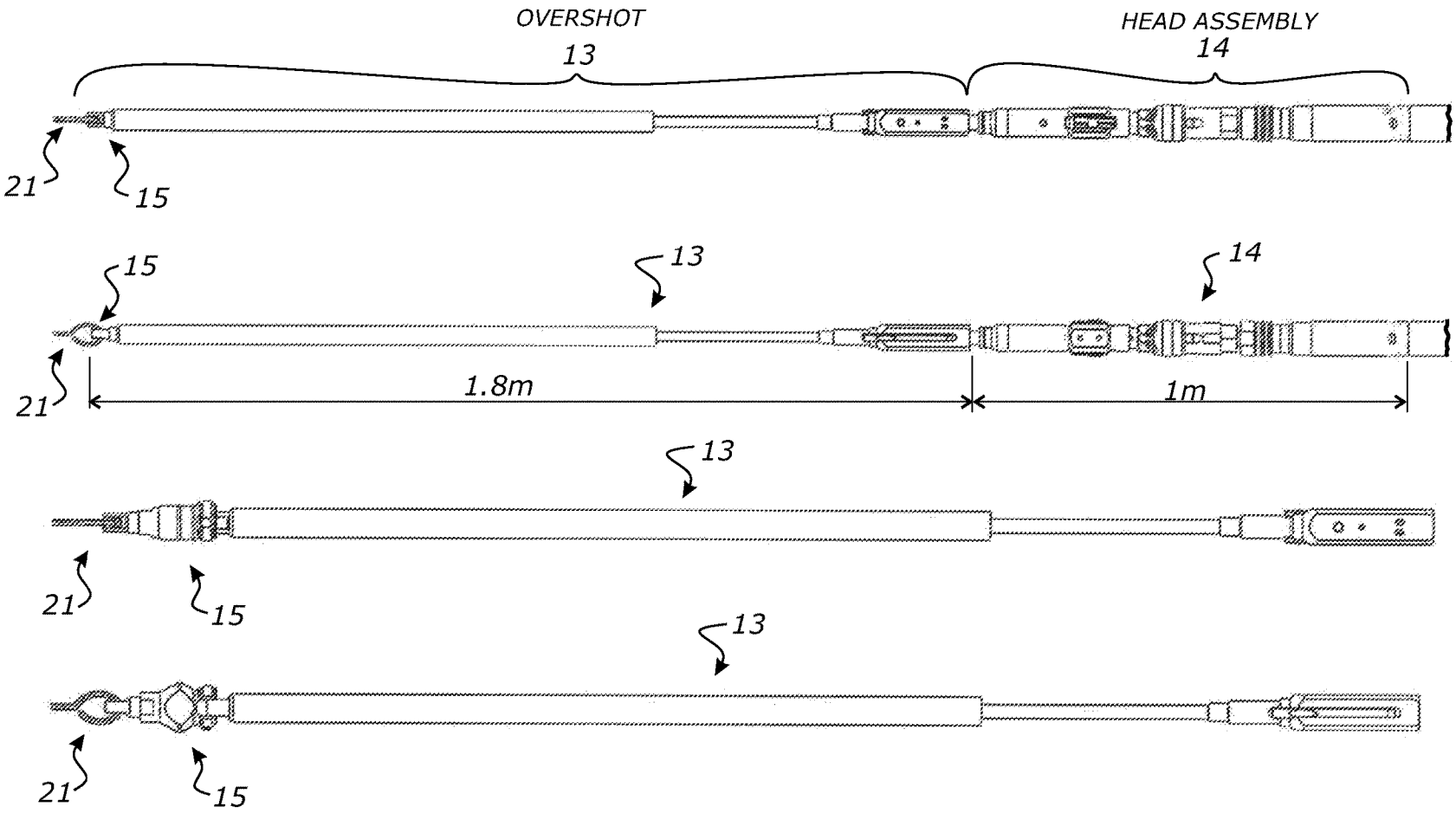
FIG. 9, 10 shows an alternative embodiment.
Figure 10:
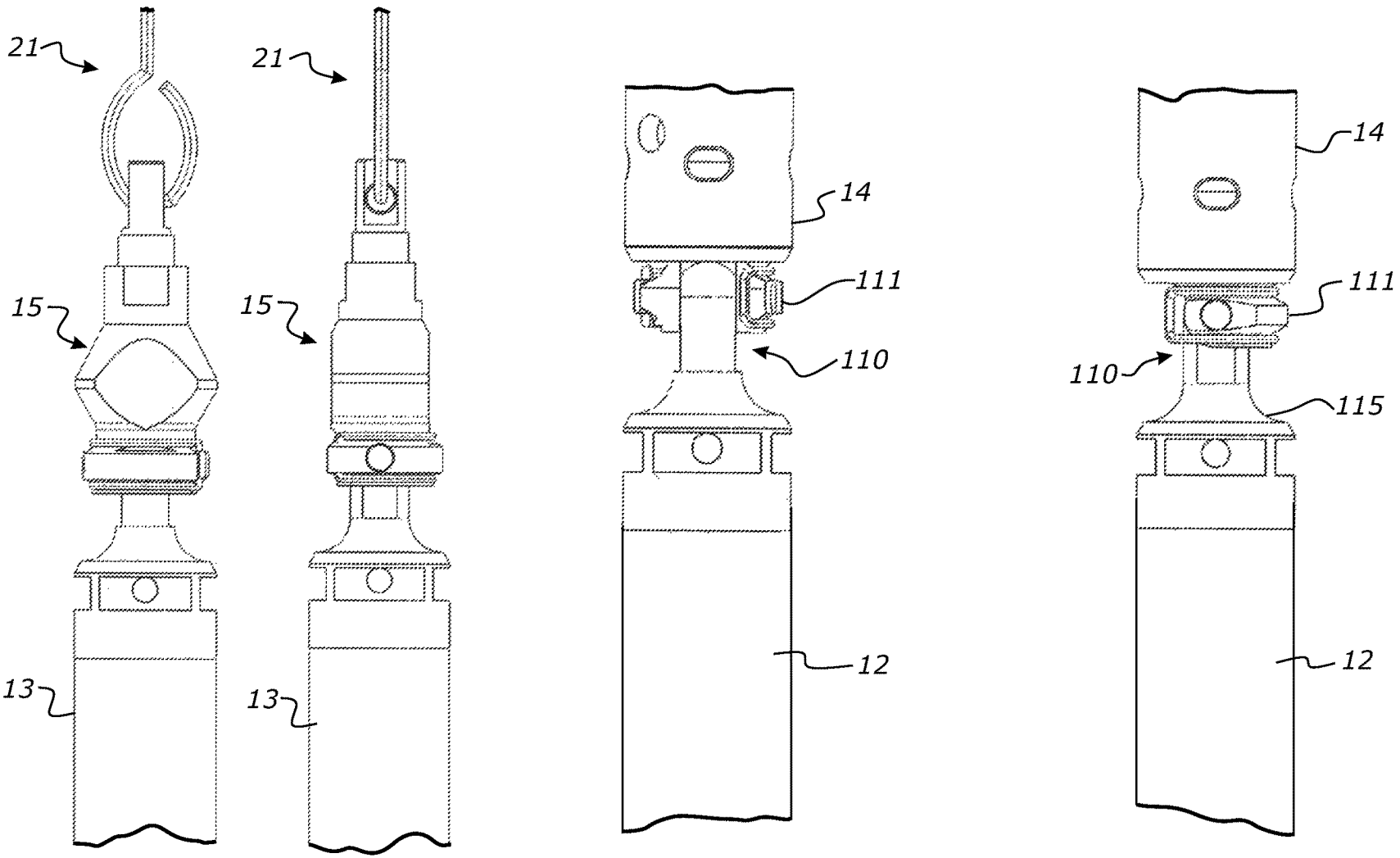

FIGS. 9 and 10 show another embodiment where there is an additional pivot coupling 15 between the wireline and overshot. This is the same pivot coupling as described above. There is also a pivot coupling between the head assembly and tool as described in the previous embodiment, but for simplicity, this is not shown. This provides an alternative mode of deployment/retrieval that will be described below.

Figure 11:
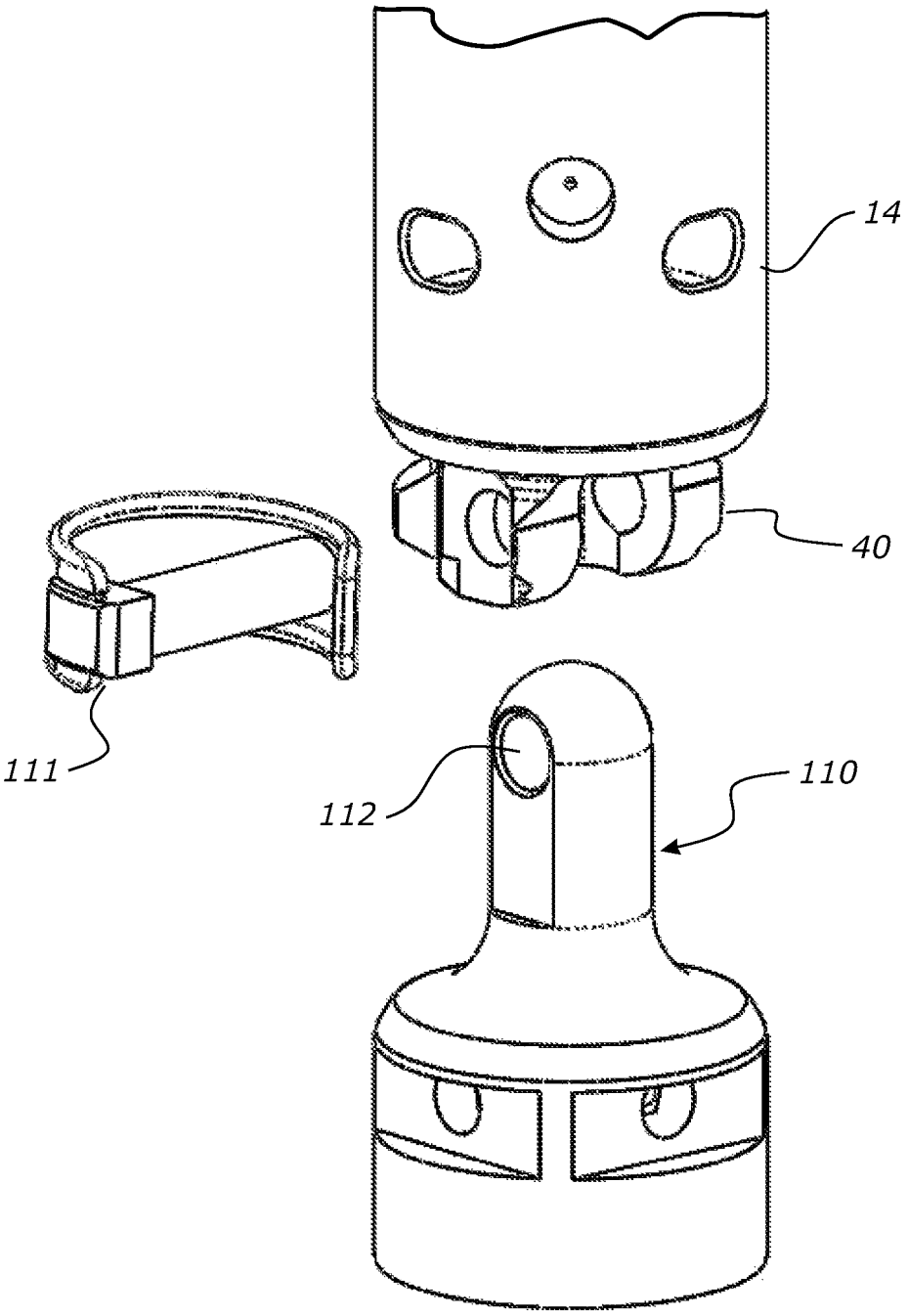
FIG. 11 shows an alternative embodiment of a pivot coupling using a rod.

FIGS. 10, 11 shows another embodiment of a pivot coupling 15. In this one, there is a clevis 40, but instead of the link being a hook 42, the link is a rod 110 with an aperture 112. The rod can extend from a base or be incorporated into a member of the apparatus as previously described. The rod is inserted into the clevis, and a removable pivot pin 111 is Inserted through the clevis hole 52 and the rod hole 112 to couple the rod to the clevis. The pivot coupling can be used as an alternative to the hook pivot coupling in any configuration previously described for the hook pivot coupling.

Methods of Installation/Deployment and Retrieval

Based on the embodiments described above, two methods of installation/deployment and retrieval of a tool are described.

In one option, just a single pivot coupling 15 is used between the head assembly 14 and tool 12. This relates to the embodiment shown in FIGS. 3 and 7. In general terms (to explained in more detail below), process works as follows.

Installation:

FIG. 7, drawing (A): The assembly is coupled together with the pivot coupling.

FIG. 7, drawing (B), (C): The assembly is handled/hoisted and articulates at the pivot coupling to assist handling.

FIG. 3, drawing (A): The assembly is hoisted into a vertical position. The retention pin can be inserted at this time, or earlier before hoisting.

FIG. 3, drawing (B): The assembly is initially lowered into the drill rods, and the retention pin is removed.

FIG. 3, drawing (C): The retention pin is fully removed and the assembly is lowered fully into the drill rods.

Retrieval:

FIG. 3, drawing (C): The assembly is removed from the drill rods.

FIG. 3, drawing (B): The retention pin is inserted into the pivot coupling so that the assembly can be handled.

FIG. 3, drawing (A): The assembly fully removed from the drill rods is hoisted into a vertical position.

FIG. 7, drawing (B), (C): the assembly is handled/lowered and articulates at the pivot coupling 15 to assist handling.

FIG. 7, drawing (A): The pivot coupling is decoupled and/or components are removed and/or replaced on the assembly, as required.

The embodiment will be described in more detail now with reference to coring, but that is exemplary only and the same or similar method could be used for other tools. First, a bore is drilled using a drill bit rotated by drill rods. The drill rods are left in place. Starting with the wireline retrieval assembly tophole, where the tool is not yet connected to the head assembly and overshot, the process comprises the following.

1. Both the head assembly and overshot are connected and are laid on the ground or similar (like in FIG. 2). The wireline is connected to the uphole end of the overshot.
2. Using the wireline, the head assembly and overshot are hoisted while the operator is guiding one part of the pivot coupling 15 on the head assembly (e.g. clevis 40) to engage with the other complementary part (e.g. hook 42) of the pivot coupling 15 on the tool (such as a coring tool, surveying tool, drilling tool, logging tool or the like). The tool can be lying on the ground. See FIG. 7, "A" and "B". For example, as described above, one part of the pivot comprises a hook or rod and the other a keeper (such as a clevis).
3. If the pivot coupling parts are a hook and keeper (such as a clevis), then a retention pin 53 is inserted to retain the pivot coupling 15 together. If the pivot coupling parts are a keeper (such as a clevis) and rod with a hole, when the pivot member is inserted through keeper (such as a clevis), the pivot member acts as both a retention pin and pivot member. See FIG. 7, "C"
4. The assembly is hoisted. As hoisting continues, the assembly articulates and the pivot coupling until the assembly is vertical (see FIG. 3, "A"), the wireline retrieval assembly is positioned over and above the drill rods. The tool 12 can then be lowered into the drill rods as per "B" and C". Before it is completely deployed, the retention pin is removed (if it is the hook and keeper configuration—see FIG. 3, "B" with the pin, and "C" without the pin), then the entire wireline retrieval assembly and tool are deployed downhole. If a short retention pin is used that is flush with the clevis lateral extensions, it does not need to be removed.

5. Once the required depth is reached, the overshot is detached from the head assembly. Latches 7 on the head assembly engage with the drill rods, the overshot is retracted back uphole using the wireline, and then coring, drilling, surveying, logging or other activity happens.
6. Once operations downhole are complete (e.g. coring, logging, drilling or surveying has taken place), the reverse happens (the rotational drive is decoupled and the overshot is deployed downhole and reattached to the latch spear head on the head assembly. The wireline then hoists the overshot bringing the head assembly and tool back up hole "C".
7. Once the pivot coupling 15A reaches surface the operator can insert the retention pin (if a hook and keeper configuration is used see FIG. 3, "B", "C") and then steps 4-1/FIG. 7, "A", "B", "C" are repeated in reverse order where a new tool is attached (such as an empty coring tool is re-connected.)

In another method, two pivot couplings 15 are used, such as shown in FIGS. 9, 10. One between the wireline 21 and overshot 13, and one between the head assembly 14 and tool 12. This configuration is used where the head assembly 14 is longer than the drill mast. For example, this method and configuration can be particularly useful where an additional tool forms part of the head assembly, thus increasing the length. Generally, the drill rig is small or the space being worked in is small. Again, the drill rods are in the borehole. There are now additional steps to take as the wire retrieval assembly is bigger than the rig. To get around this problem, an additional pivot coupling 15 couples the wireline to the overshot to enable the operating personnel to remove the overshot and head assembly from the tool 12 when the wire retrieval assembly is either lowered back down hole or bought back uphole. The additional steps are as follows.

1. The head assembly and overshot are laid on the ground separate from the tool 12.
2. The wireline is connected to the tool via a pivot coupling (part of pivot coupling e.g. clevis on the wireline to part of pivot coupling e.g. hook on the tool). Both the wireline and tool are hoisted up and the tool lowered into the drill rods and dropped down so that it is level with or just above the drill rod tophole. A claw or similar then holds the uphole end of the tool in place in the drill rods and the wireline is then disengaged from the tool by decoupling the pivot coupling.
3. The wireline is then coupled to the overshot that is attached to the head assembly. This is then hoisted up and guided over to the tool retained in the drill rods.
4. The head assembly is now connected to the tool via the pivot coupling 15. If required, the retention pin is then inserted.
5. The claw is then removed from the tool along with the retention pin if used.
6. The wireline retrieval assembly 11 and the tool 12 are now lowered downhole to deploy the tool downhole. This process occurs by the overshot disengaging the head assembly once the necessary depth is reached, the wireline is then hoisted out of the drill rods.
7. Once operations downhole are complete (e.g. coring, logging, drilling or surveying has taken place), the overshot is lowered back downhole using the wireline to engage to the head assembly. This is then pulled back up hole so that the bottom of the head assembly or top of the tool is level with or just above the top of the cased hole. The retention pin is inserted (if configuration requires it) and/or the claw is engaged with the tool to then hold the tool in place in the borehole.
8. The tool and head assembly pivot coupling 15 is disengaged so that the head assembly and overshot can then be hoisted up and laid on the ground, whilst the tool is still being held in the hole.
9. The wireline is then reconnected to the tool via a pivot coupling (part of pivot coupling 15 on the wireline to part of pivot coupling 15 on the tool). Both the wireline and tool are hoisted up and the tool raised out of the drill rods.

Both methods provide advantages over the prior art. First, the wireline, overshot, head assembly and tool can be decoupled and coupled as required during deployment/retrieval so the operator can work with smaller and lighter components. This is compared to prior art systems, where the entire assembly (overshot, head assembly and tool) needs to be handled, which is larger and heavier. Furthermore, the coupling and decoupling can occur easily using the couplings. Also, the wireline, head assembly and tool can articulate, which makes for easier handling and manoeuvre of the assembly, even when it is one piece. All this leads to safer and easier operation.

The pivot coupling itself is lighter and more easily handled. The portion on the tool can be decoupled from the tool (e.g. unthreaded) thus allowing access to the tool, for e.g. accessing a core sample.

The prior art requires that there is always at least TWO wireline retrievable and downhole apparatuses at the surface (e.g. system assembly and assembly two) for efficient operation. Once assembly one is bought back uphole man handled and laid on the ground, the wireline is then disengaged from the overshot and reconnected to the overshot of assembly two. Process repeated with assembly two—again manhandled. While assembly two is downhole, the off sider must threadably disconnect the downhole apparatus from the head assembly. Typically, the head assembly weighs around 10-20 kg—so must untwist this from the downhole tool so that the contents of the downhole tool can be emptied out. The arrangement described herein allows the use of just one overshot and head assembly unit while still remaining time efficient (this means less outlay for equipment, quicker, increased efficiency). Thus, when the tool comes back uphole, only the tool is removed and the overshot and head assembly can then reattach to a different tool. Thus, the off sider is not having to untwist the wireline retrieval assembly from the downhole tool. This is quicker, prevents cross threading risk, lessens having to man handle the 10-20 kg head assembly etc. This becomes an even more important advantage when the head assembly incorporates additional length and weight by the introduction of additional apparatus into the head assembly. Thus, the overall length of the head assembly may increase from say 1 m to 3 m and the weight increases from 10-20 kg to say 50-70 kg. Alternatively, if the additional apparatus is incorporated into the downhole tool—then again, these similar advantages apply.

Another advantage is that the off sider, if they decide to empty out the contents of the downhole tool from the uphole end of the tool where the pivot coupling is provided—then the off sider can simply unscrew the hook or clevis off the pivot coupling. This pivot coupling is light weight and readily removable. This can be seen in FIG. 4.

If using two pivot couplings—in addition to the above points, major advantages include the ability to break the unit into manageable sizes and weights for the off sider to handle whilst at surface.

The invention claimed is:

1. A wireline retrieval head assembly and downhole tool, the wireline retrieval head assembly for coupling to the downhole tool for installation in and retrieval from downhole in a mineral industry field of use, wherein a first of the wireline retrieval head assembly and downhole tool has a clevis that has or is configured to receive a pivot pin, and a second of the wireline retrieval head assembly and downhole tool has a complementary hook with an opening for receiving the pivot pin, such that the hook can be coupled to the clevis to create a pivot coupling to allow for articulation between the wireline retrieval head assembly and the downhole tool during installation and retrieval of the downhole tool, and the hook can be removed from the clevis to remove the downhole tool from the wireline retrieval head assembly, and wherein the hook and/or clevis has an aperture for receiving a retention pin that can be removably installed to secure the hook to the clevis.

2. A wireline retrieval head assembly and downhole tool according to claim 1 wherein:

the clevis has a coupling for removably attaching the clevis to the first of the wireline retrieval head assembly or downhole tool; and/or the complementary hook has a coupling for removably attaching the clevis to the second of the wireline retrieval head assembly or downhole tool.

3. A wireline retrieval head assembly and downhole tool according to claim 1 wherein:

the clevis is integrated with the first of the wireline retrieval head assembly or downhole tool; and/or the complementary hook is integrated with the second of the wireline retrieval head assembly or downhole tool.

4. A wireline retrieval head assembly and downhole tool according to claim 1 wherein the clevis has lateral extensions to laterally retain and/or rotationally restrain the hook when coupled.

5. A wireline retrieval head assembly and downhole tool according to claim 1 wherein the hook is a rod with the opening.

6. A wireline retrieval head assembly and downhole tool according to claim 1 further comprising a further tool coupled to and forming part of the head assembly.

7. A wireline retrieval head assembly and downhole tool according to claim 1 wherein the downhole tool is any one of: a coring tool, drilling tool, hammering tool, surveying tool, or logging tool.

8. A pivot coupling to removably and pivotably couple a wireline retrieval head assembly and a downhole tool for installation in and retrieval from downhole in a mineral industry field of use, wherein the pivot coupling comprises a clevis that has or is configured to receive a pivot pin, the clevis integrated in or configured to connect to a first of the wireline retrieval assembly and downhole tool; and a complementary hook with an opening for receiving the pivot pin, the hook integrated in or configured to connect to a second of the wireline retrieval head assembly and downhole tool, such that in use the hook can be coupled to the clevis and pivot pin to create the pivot coupling between the wireline retrieval head assembly and the downhole tool during installation and retrieval of the downhole tool, and the hook can be removed from the clevis and pivot pin to remove the downhole tool from the wireline retrieval assembly, and wherein the hook and/or clevis has an aperture for receiving a retention pin that can be removably installed to secure the hook to the clevis.

9. A pivot coupling according to claim 8 wherein the clevis has lateral extensions to laterally retain and/or rotationally restrain the hook when coupled.

10. A pivot coupling according to claim 8 wherein the hook is a rod with the opening.

11. A pivot coupling according to claim 8 wherein the downhole tool is any one of: a coring tool, drilling tool, hammering tool, surveying tool, or logging tool.

12. A method of installing a tool downhole in a mineral industry field of use using a wireline retrieval assembly comprising an overshot coupled to a wireline retrieval head assembly, the method comprising the steps of:

coupling at least the wireline retrieval assembly to a downhole tool with a pivot coupling of claim 8 hoisting the wireline retrieval assembly from a surface or support using a wireline, in doing so at least the wireline retrieval assembly and downhole tool pivot at the pivot coupling, and lowering the wireline retrieval assembly and tool downhole.

13. A method according to claim 12 further comprising detaching the overshot from the wireline retrieval head assembly.

14. A method of retrieving a tool from downhole installed according to claim 12 comprising the steps of:

retrieving the wireline head assembly and downhole tool using a wireline and overshot to hoist the downhole tool from downhole, lowering the wireline retrieval assembly and tool to lay the assembly on a support or surface, in doing so the wireline retrieval assembly and/or tool pivot at the pivot coupling, removing the hook from the clevis to disassemble the wireline retrieval assembly from the tool to retrieve the tool.

* * * * *